United States Patent [19]

Miller et al.

[11] 3,994,459

[45] Nov. 30, 1976

[54] RAILWAY VEHICLE DERAILMENT DETECTION SYSTEM

[75] Inventors: Geoffrey D. Miller, Plymouth; Ernest J. Moorey, Ivybridge, both of England

[73] Assignee: M.L. Engineering (Plymouth) Limited, Slough, England

[22] Filed: Apr. 15, 1975

[21] Appl. No.: 568,157

[30] Foreign Application Priority Data

Apr. 18, 1974 United Kingdom ..... 16906/74

[52] U.S. Cl. ..... 246/173; 246/DIG. 1

[51] Int. Cl.[2] ..... B61L 3/12

[58] Field of Search ..... 246/170, 173, 169 R, 246/169 D, DIG. 1; 116/114 AH

[56] References Cited

UNITED STATES PATENTS 998,513 7/1911 Hill ..... 246/173

2,391,228 12/1945 Day ..... 246/170

*Primary Examiner*—Trygve M. Blix
*Assistant Examiner*—Reinhard J. Eisenzopf
*Attorney, Agent, or Firm*—Cushman, Darby & Cushman

[57] ABSTRACT

In order to detect derailment of a railway vehicle each vehicle in a train is provided with an acceleration responsive device which, in response to the vehicle acceleration resulting from derailment of the vehicle transmits a short range radio signal to a receiver installed in the engine to provide a visual or audio alarm. In one practical arrangement requiring no routine maintenance each transmitter unit has a resonant circuit which is energized as a result of the stressing of a piezo-electric crystal upon vehicle derailment, avoiding the need for any separate electrical power source on the vehicle.

10 Claims, 4 Drawing Figures

RAILWAY VEHICLE DERAILMENT DETECTION SYSTEM

BACKGROUND OF THE INVENTION

This invention relates to a railway vehicle derailment detection system.

In some railway systems which do not have elaborate track signalling, particularly in some countries where there is an extensive network of single track railways, it is possible for an individual unit of rolling stock, or an individual bogey, in a long train to become derailed without halting the train and without this being immediately apparent to the train driver or guard. If, as frequently happens, the train continues on its journey, the derailed vehicle or bogey can cause considerable damage to the track, particularly if it passes over a points system or through a station.

With a view to avoiding such damage an object of the present invention is to provide a derailment detection system which can afford an immediate warning to the train operating staff of derailment of an individual railway vehicle in a train.

SUMMARY OF THE INVENTION

According to the invention there is provided a railway vehicle derailment detection system comprising a radio transmitter adapted to be mounted on a railway vehicle in a train, the transmitter including means responsive to the vertical acceleration resulting from derailment of the vehicle to cause the transmitter to transmit a radio signal, and a receiver, adapted to be mounted at a control location on the train, said receiver including alarm means responsive to the reception of said radio signal to provide a warning of derailment of the vehicle on which the transmitter is mounted.

The control location will in general be the driver's cab in the engine towing the train.

The system according to the invention has the advantage that the radio transmitter in each railway vehicle can be of simple and inexpensive construction, so that it is economical to mount a transmitter on each vehicle of a train. Moreover, each transmitter may be arranged to be completely self-contained, with its own power source. The transmitter may, for example, include a dry battery power source so that no electrical connections between individual railway vehicles are required to complete the detection system. Given a suitable type of dry battery power source, such as a mercury cadmium cell, the transmitter on each railway vehicle can be such that it does not require any servicing or attention over several years. Robustness of the transmitter can be ensured by encapsulating its electronic components in epoxy resin.

The radio transmitter would in practice be a very low power transmitter since the effective range of the transmitted signals need only be of the order of one mile to embrace all practical distances between a railway vehicle of any one train and a receiver mounted in another vehicle in the train, usually in the engine pulling the train.

The system should include means for distinguishing between signals transmitted by individual vehicle-mounted transmitters and spurious signals, including radio interference. The receiver therefore preferably includes gate and/or filter means connected to the alarm or warning device and effective to initiate operation of the alarm or warning device only upon receiving a signal having a frequency duration and/or amplitude within predetermined limits. The receiver may also include a bistable circuit which switches on and maintains the operation of the alarm or warning device upon being triggered by the reception of a signal having the requisite characteristics.

The acceleration-responsive means may include a switch which is closed in response to the vertical acceleration of the vehicle upon derailment to cause the discharge of a charged capacitor through the transmitter to energise the latter. The acceleration-responsive switch may for example be associated with a vertically movable inertial mass which is displaced sufficiently in response to the acceleration resulting from derailment of the vehicle to close the switch and discharge the capacitor into the transmitter.

In the ordinary course of operation a railway vehicle is subjected to several shocks, usually horizontally directed, and the acceleration-responsive means must be such that it is insensitive to such shocks and to the vertical acceleration to which it is subjected in the ordinary use of the railway vehicle, for example when passing over points systems or joints between tracks. It is a simple matter in practice to arrange that the acceleration responsive means is selectively responsive in this way, since the vertical jolt or acceleration resulting from derailment of a vehicle is substantially greater than any vertical acceleration which may occur in ordinary use.

In a preferred practical embodiment of the invention the radio transmitter includes a piezo-electric element mechanically connected to or forming part of the acceleration responsive means so that the element is strained in response to the acceleration resulting from derailment of the vehicle on which the transmitter is mounted to cause the generation of a voltage across the piezo-electric element which is utilised to generate the said radio signal. For example, the piezo-electric element may be connected through a threshold device to a resonant electrical circuit which is "rung" in response to a voltage across the piezo-electric element resulting from vehicle derailment. Alternatively, the piezo-electric element may be directly connected to a spark gap which is so gauged that a spark appears across the gap only when the piezo-electric element is subjected to a force resulting from vehicle derailment, the spark acting as the source of radio waves which is picked up by the receiver.

In practical embodiments of the invention a single transmitter may be mounted on each railway vehicle of a train, centrally between the ends of the vehicle, so that it is responsive to derailment of the wheels or bogeys at either end of the vehicle to provide the requisite radio signals.

BRIEF DESCRIPTION OF THE DRAWINGS

The invention will now be described, by way of example, with reference to the accompanying drawings, in which.

DESCRIPTION OF THE ILLUSTRATED EMBODIMENTS

Figure 1:
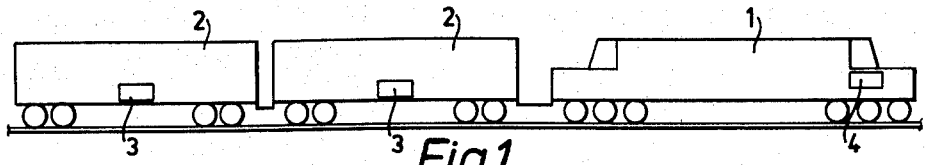
FIG. 1 is a diagrammatic representation of a train equipped with a derailment detection system according to the invention.

FIG. 1 of the drawings represents a railway train having an engine 1 towing vehicles 2. Each vehicle 2 is provided with a transmitter unit 3 which is completely self-contained with no electrical connections to other vehicles or to the engine 1. Each transmitter unit 3 is located on the respective vehicle 2 centrally between the ends of the vehicle so as to be responsive to the vertical acceleration of the respective vehicle 2 resulting from derailment of either one or both ends of the vehicle 2 to transmit radio signals which are picked up by a receiver unit 4 mounted in the engine 1. The receiver unit 4 upon receiving signals from any of the transmitter units 3 activates a warning device to warn the engine driver that a derailment has occurred.

Figure 2:
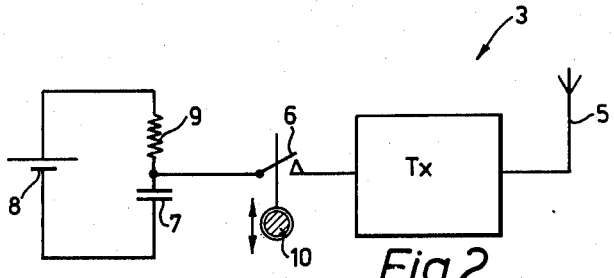
FIG. 2 is a schematic circuit diagram of one form of transmitter for use in the system according to the invention.

The transmitter unit, shown schematically in FIG. 2, comprises a low power solid state transmitter circuit T*x*, preferably encapsulated in epoxy resin, having a suitable antenna 5, for example a ferrite rod antenna. The transmitter is normally switched off and is switched on by closure of an acceleration-responsive switch 6 which, upon closure, discharges a charged capacitor 7 through the transmitter T*x* to cause the latter to generate a burst of radio pulses of a predetermined length and amplitude. The capacitor 7 is maintained in a charged condition by a battery 8, preferably a dry cell of long duration such as a mercury-cadmium cell, connected in a closed circuit with the capacitor 7 through a resistor 9.

The acceleration-responsive switch 6 is arranged to be responsive to vertical accelerations of the unit 3, and in particular to the large vertical acceleration or jolt which occurs upon derailment of either end of the vehicle 2. Such acceleration-responsive switches are commercially available and generally include an inertial mass, indicated diagrammatically at 10 in FIG. 2, which descends, usually against a frictional resistance, to close the associated switch 6 only in response to an acceleration above a given threshold. For example, the inertial mass 10 may comprise a ball movable vertically in a tube and arranged to close electrical contacts constituting the switch 6 when it descends in the tube upon being subjected to the requisite acceleration.

The entire transmitter unit 3 is preferably such that it can be easily mounted and demounted, for example by simply bolting it to the side of the vehicle 2. No electrical connections or mechanical couplings to the unit 3 are called for, and the mounting and demounting of the unit 3 can therefore be carried out by unskilled labor. Moreover, since the unit has no parts requiring servicing or maintenance it may be mounted in a suitably protective cover or housing and will need no attention, except possibly recharging or replacement of the battery 8 at long intervals.

Figure 3:
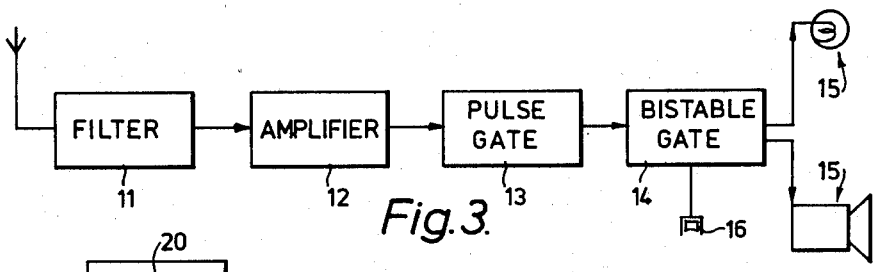
FIG. 3 is a schematic circuit diagram of a typical receiver forming part of the system according to the invention.

The receiver unit 4 mounted in the engine 1 is illustrated diagrammatically in FIG. 3 and includes a filter 11 and amplifier 12 connected to a receiver antenna. Dependent upon the wavelength of the radio transmissions from the transmitter T*x* the filter 11 may be replaced by a heterodyne receiver unit. The output from the amplifier 12 is passed through a pulse gate 13 which transmits the signals to a bistable gate 14 only when the incoming signals have a characteristic which matches that of the signals transmitted by the transmitter T*x* — that is, when the burst of radio frequency pulses has a length within predetermined limits. Any other suitable filter or gate circuit for selectively transmitting to the bistable gate 14 only the characteristic signals emmitted by the transmitter T*x* may be provided.

The bistable gate 14 is opened in response to the received signals passed to it through the gate 13 to energise an alarm device 15 which may be an audio alarm in the driver's cab, and/or a visual alarm such as a flashing light. The bistable gate upon being triggered will remain in the stable closed condition, maintaining the alarm or warning device 15 in operation until the bistable gate 14 is reset manually by a reset switch 16.

Figure 4:
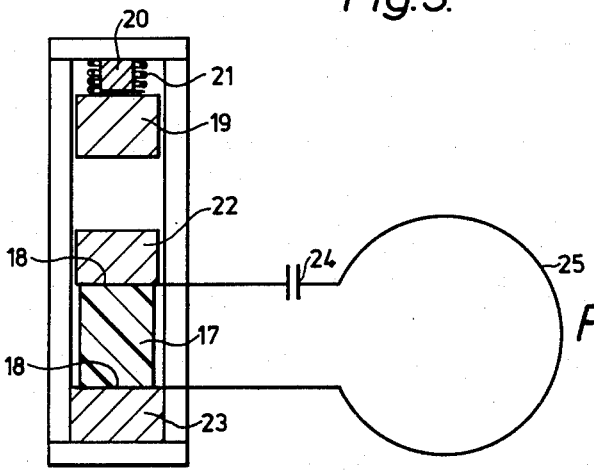
FIG. 4 is a schematic representation of an alternative type of transmitter for use in a system according to the invention.

FIG. 4 illustrates an alternative type of transmitter which may be used in some practical embodiments of the invention. Instead of employing a battery power source the embodiments of FIG. 4 utilises a piezo-electric crystal 17 mounted between electrode plates 18 and forming a load cell of a conventional type. The piezo-electric crystal 17 is located beneath and spaced from a vertically displaceable inertial striker 19 which is restrained by the attraction of a permanent magnet 20 and acted upon by a return spring 21. The magnetic restraint on the striker 19 is overcome in response to vertical accelerations of the vehicle on which the transmitter unit is mounted characteristic of derailment of the vehicle to allow the striker to impinge on the crystal 17, stressing the latter between a load-diffusing member 22 and an anvil 23.

The electrode plates 18 on opposite faces of the piezo-electric load cell are connected directly to a resonant circuit comprising a capacitor 24 and an inductive loop 25 which also acts as a transmitter antenna. The resonant circuit is "rung" when the voltage across the electrodes 18 reaches a threshold level corresponding to the loading of the crystal 17 resulting from vehicle derailment.

Alternatively a spark gap may be connected across the electrode plates 18. When the stress in the piezo-electric crystal 17 reaches or exceeds a threshold level, corresponding to the stress induced in the crystal 17 by the striker 19 upon vehicle derailment, sparks are produced across the gap which generate radio waves capable of detection in the receiver unit 4.

In practice when any one vehicle or bogey is derailed the vertical shocks resulting from derailment will be repetitive, as the vehicle or bogey wheels pass over successive railway sleepers, and the repetition rate of the resultant radio signals transmitted by the transmitter unit 3 mounted on the vehicle will be proportional to the vehicle speed and may also be used to discriminate the transmitted signals from spurious external radio signals or interference, for example radio signals resulting from lightening flashes in the vicinity of the train.

We claim:

1. A railway vehicle derailment detection system comprising a radio transmitter mounted on a railway vehicle in a train, the transmitter including means responsive to the vertical acceleration resulting from derailment of the vehicle to cause the transmitter to transmit a radio signal, and a receiver adapted to be mounted at a control location on the train, said receiver including alarm means responsive to the reception of said radio signal to provide a warning of derailment of the vehicle on which the transmitter is mounted.

2. The system defined in claim 1, wherein the receiver includes gate and filter means, said alarm means being connected to said gate and filter means, whereby operation of the alarm means is initiated only upon reception of a signal having a frequency, duration and amplitude within predetermined limits.

3. The system defined in claim 2, wherein the receiver includes a bistable circuit adapted to switch on and maintains the operation of the alarm warning device upon being triggered by the reception of a said signal having a frequency, duration and amplitude within predetermined limits.

4. The system defined in claim 1, wherein the radio transmitter includes a battery power source the acceleration-responsive means including a switch which is closed in response to the vertical acceleration resulting from derailment of the vehicle a capacitor connected to said switch and a charging circuit connected to said capacitor, said capacitor being discharged through the transmitter to energise the latter upon closure of said switch.

5. The system defined in claim 1, wherein the radio transmitter includes a piezo-electric element mechanically connected to the acceleration responsive means, the element being strained in response to the acceleration resulting from derailment of the vehicle on which the transmitter is mounted to cause the generation of a voltage across the piezo-electric element which energises the radio transmitter.

6. The system defined in claim 5, wherein the acceleration responsive means includes a displaceable striker, holding means releasably retaining said striker out of contact with the piezo-electric element, said holding means releasing the striker in response to vertical acceleration of the vehicle resulting from derailment of the vehicle to allow the latter to impinge on the piezo-electric element.

7. The system defined in claim 6, wherein the holding means comprise a permanent magnet.

8. The system defined in claim 5, including a resonant electrical circuit directly connected to the piezo-electric element, and an antenna connected to said resonant circuit.

9. The system defined in claim 8, wherein the antenna is constituted by an inductive loop of the resonant circuit.

10. The system defined in claim 5, wherein the transmitter is mounted on the railway vehicle centrally between the ends of the vehicle, so as to be responsive to derailment of either end of the vehicle to generate said radio signal.

* * * * *